US007066059B1

(12) United States Patent
Hsieh

(10) Patent No.: US 7,066,059 B1
(45) Date of Patent: Jun. 27, 2006

(54) BENDABLE SPANNER

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/032,618

(22) Filed: Jan. 11, 2005

(51) Int. Cl.
*B25B 23/16* (2006.01)

(52) U.S. Cl. ..... 81/177.7; 81/177.6; 81/177.8

(58) Field of Classification Search ..... 81/177.6–177.8
See application file for complete search history.

(56) References Cited

U.S. PATENT DOCUMENTS

| | | | | |
|---|---|---|---|---|
| 1,316,698 | A * | 9/1919 | Steininger | 81/119 |
| 1,805,298 | A * | 5/1931 | Frederick | 81/177.8 |
| 2,426,763 | A * | 9/1947 | Curtis | 81/125.1 |
| 2,978,938 | A * | 4/1961 | Nalley | 81/177.8 |
| 4,334,445 | A * | 6/1982 | Timewell | 81/177.7 |
| 5,331,869 | A * | 7/1994 | Webb | 81/177.1 |
| 6,167,787 | B1 * | 1/2001 | Jarvis | 81/177.2 |
| 6,324,947 | B1 * | 12/2001 | Jarvis | 81/177.2 |
| 6,336,383 | B1 * | 1/2002 | Hung | 81/60 |
| 6,382,058 | B1 * | 5/2002 | Owoc | 81/177.9 |
| 6,412,374 | B1 * | 7/2002 | Hsieh | 81/177.7 |
| 6,557,442 | B1 * | 5/2003 | Owoc | 81/177.9 |
| 6,877,404 | B1 * | 4/2005 | Chen | 81/177.7 |
| 2004/0083861 | A1 * | 5/2004 | Hu | 81/177.8 |
| 2004/0261586 | A1 * | 12/2004 | Chen | 81/177.7 |

* cited by examiner

*Primary Examiner*—David B. Thomas

(57) ABSTRACT

A bendable spanner comprises a driving head having a driving portion at a front end thereof for engaging with a screw means; a length of the driving head being L3; a pivotal unit; the driving head being pivotally installed to the pivotal unit; a length of the pivotal unit being L2; and a holding portion; one end of the holding portion being pivotally installed to the pivotal unit; a length of the holding portion being L1. The length of L1 is greater than or equal to 1.5 times of the L2, and the length of L1 is greater than or equal to 1.15 times of L3. Moreover in the present invention, another end of the holding portion is connected to a pivotal unit and then the pivotal unit is further connected to a driving head.

4 Claims, 12 Drawing Sheets

BENDABLE SPANNER

FIELD OF THE INVENTION

The present invention relates to spanners, and in particular to a bendable spanner, wherein the bendable spanner has three stages so that the bendable spanner can be adjusted to suit for various work environments.

BACKGROUND OF THE INVENTION

Spanners are frequently hand tools in the mechanic operations. However it is very often that the users must operate the spanner in some complicated conditions so that the users will feel uneasy. This reduces the work efficiency.

Thereby to improve above-mentioned problems, some newly designs are developed. In one improvement, the spanner has a driving head and a holding portion. The driving head is bended with an angle with respect to the holding portion so that the users can operate the spanner in a tilt angle. However in this prior art, the bending angle between the holding portion and the driving head is determined in the manufacturing process so that only little conditions are suitable for this spanner. Furthermore, although it can resolve some problems in the prior art, but it is not so convenient as the prior art straight spanner.

Moreover in another improved structure, the spanner is designed to have a holding portion and a driving head. The driving head is pivotally installed to the holding portion so that when the spanner is operated in some complicated work places, the spanners are bendable to suit the work environment. However this prior art only improves some problems in the prior art, this is because the spanner is only divided into two parts and the rotation angle of the driving head is confined and thus there still are many work conditions which are not suitable to this improved spanner. Furthermore, since only one pivotal structure, the holding portion and driving head cannot be adjusted to be parallel, but not in the same line. Thereby the driving head and the holding portion are not in the same line, and thus the arm of force is small. As a result, the work efficiency is low.

SUMMARY OF THE INVENTION

Accordingly, the primary object of the present invention is to provide a bendable spanner, wherein the bendable spanner has three stages so that the bendable spanner can be adjusted to suit for various work environments.

To achieve above objects, the present invention provides a bendable spanner which comprises a driving head having a driving portion at a front end thereof for engaged with a screw means; a length of the driving head being L3; a pivotal unit; the driving head being pivotally installed to the pivotal unit; a length of the pivotal unit being L2; and a holding portion; one end of the holding portion being pivotally installed to the pivotal unit; a length of the holding portion being L1. The length of L1 is greater than or equal to 1.5 times of the L2, and the length of L1 is greater than or equal to 1.15 times of L3. Moreover in the present invention, another end of the holding portion is connected to a pivotal unit and then the pivotal unit is further connected to a driving head.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
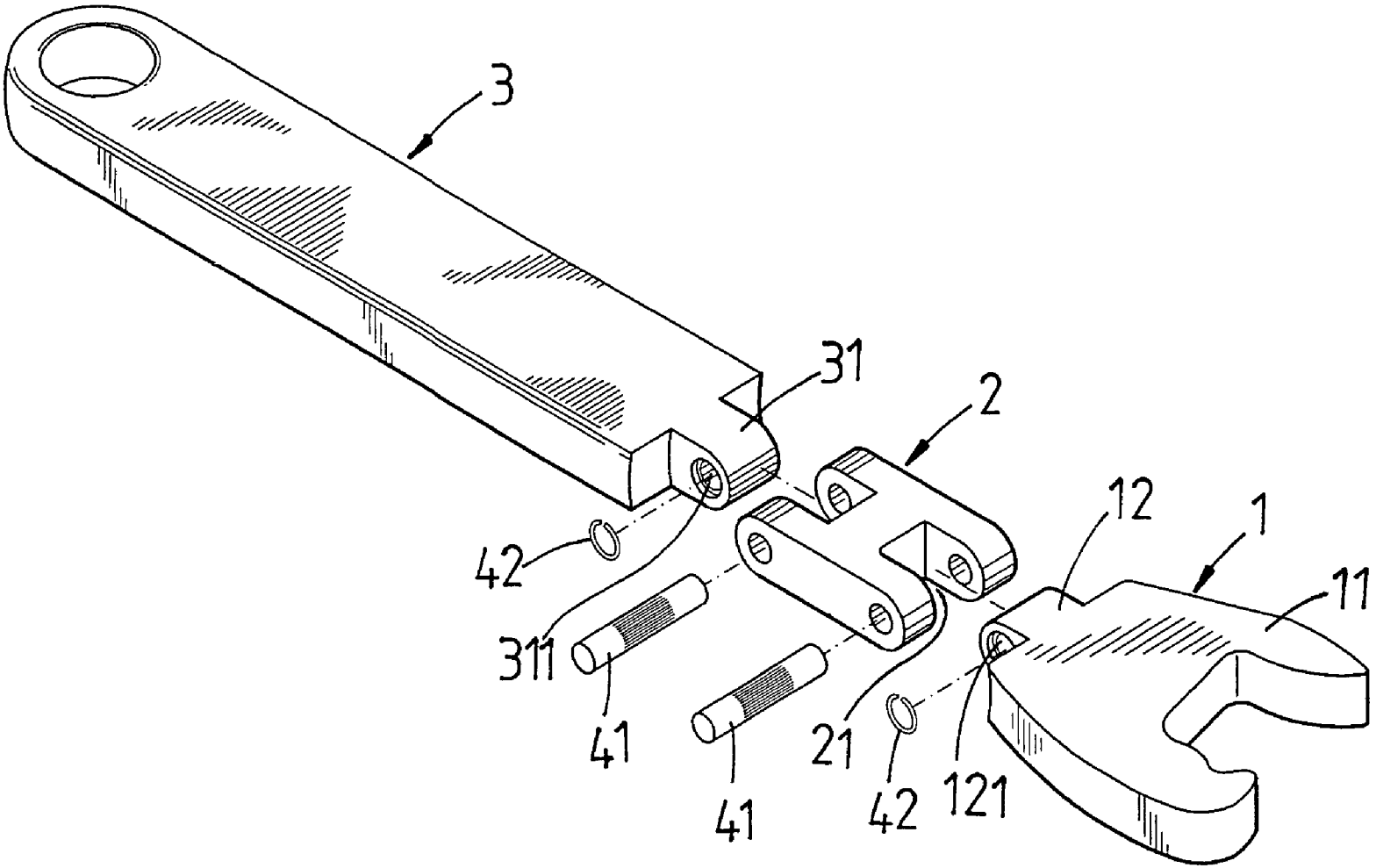
FIG. 1 is an exploded view of the bendable spanner of the present invention.
Figure 2:
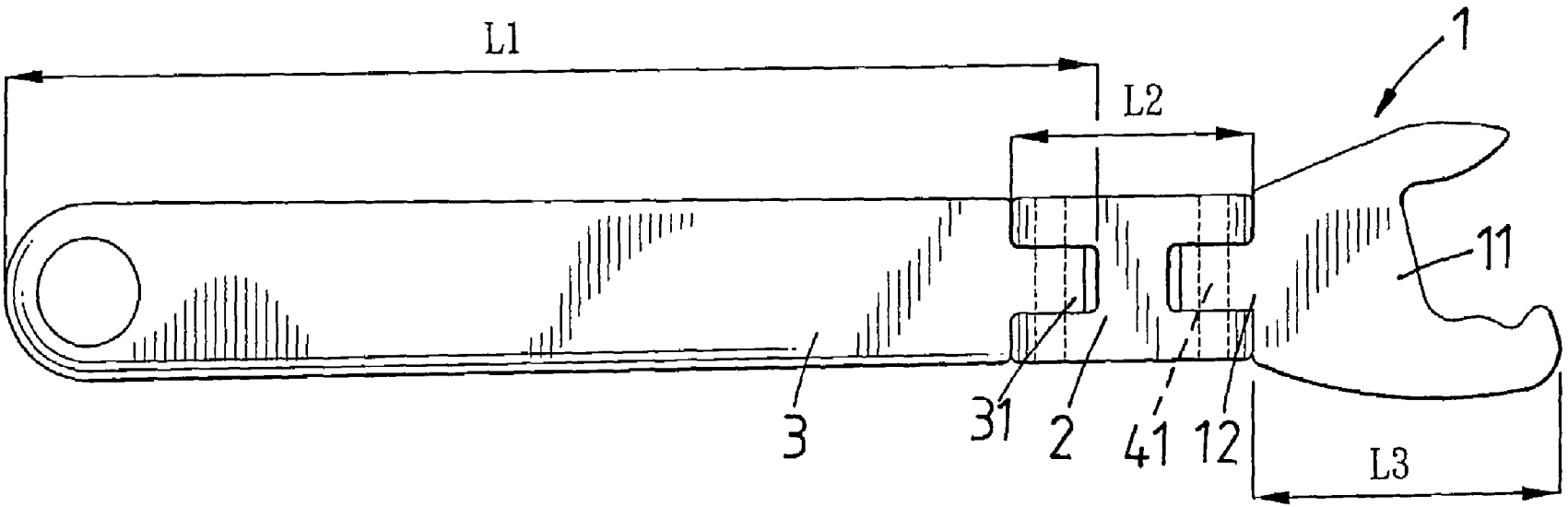
FIG. 2 is an elevational view of the bendable spanner of the present invention.
Figure 3:
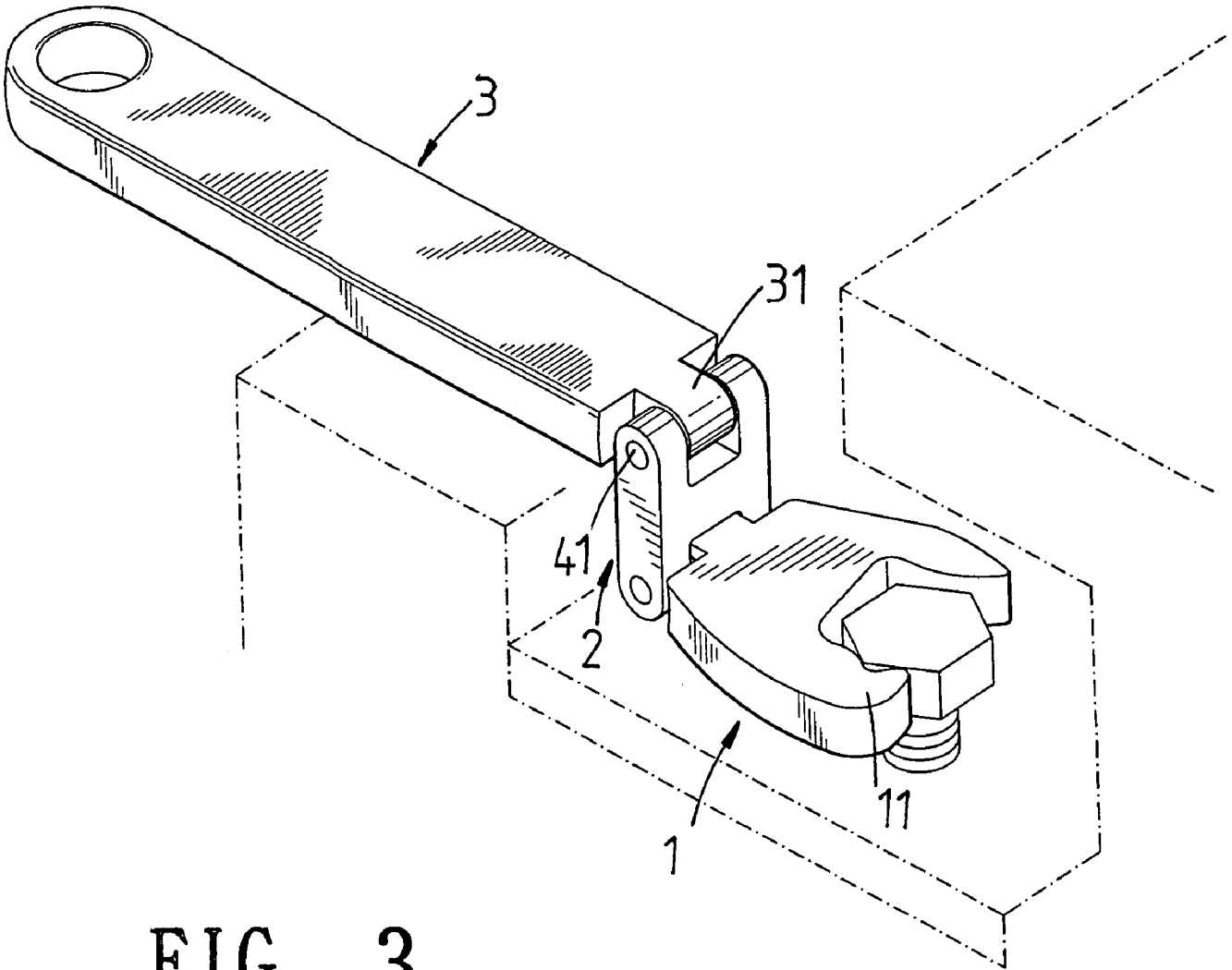
FIGS. 3 to 7 show that the present invention can be used in various conditions.
Figure 4:
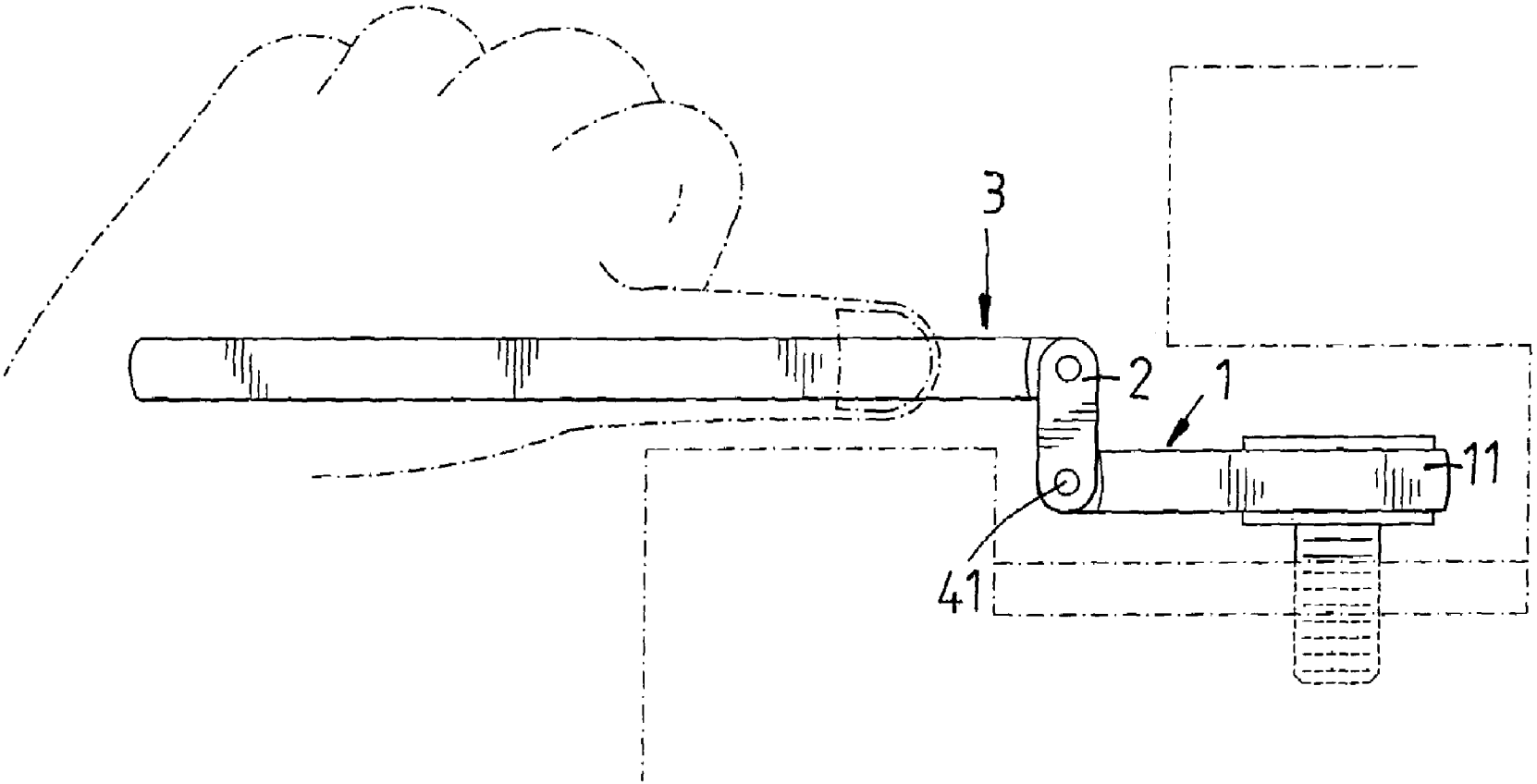
Figure 5:
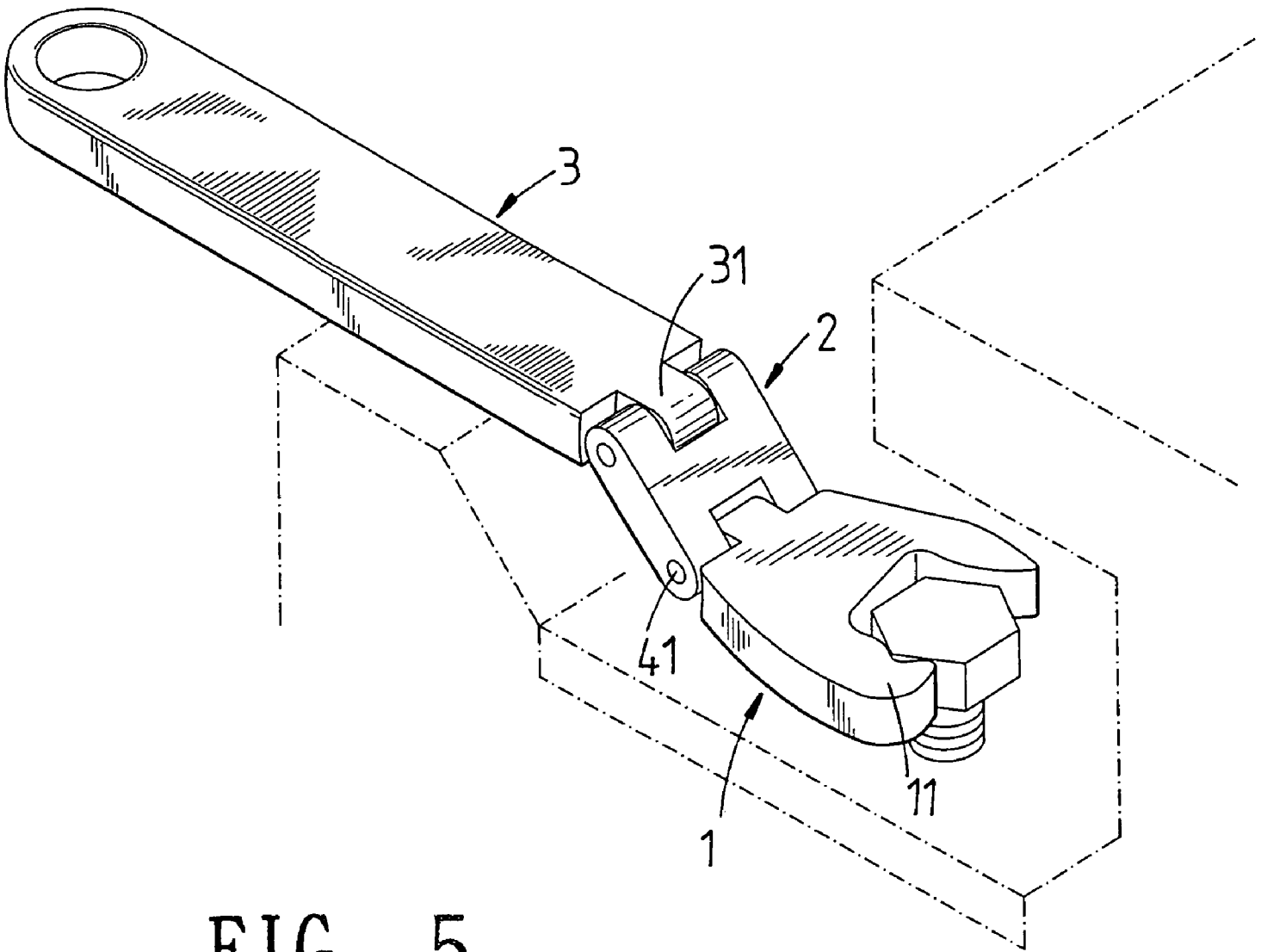
Figure 6:
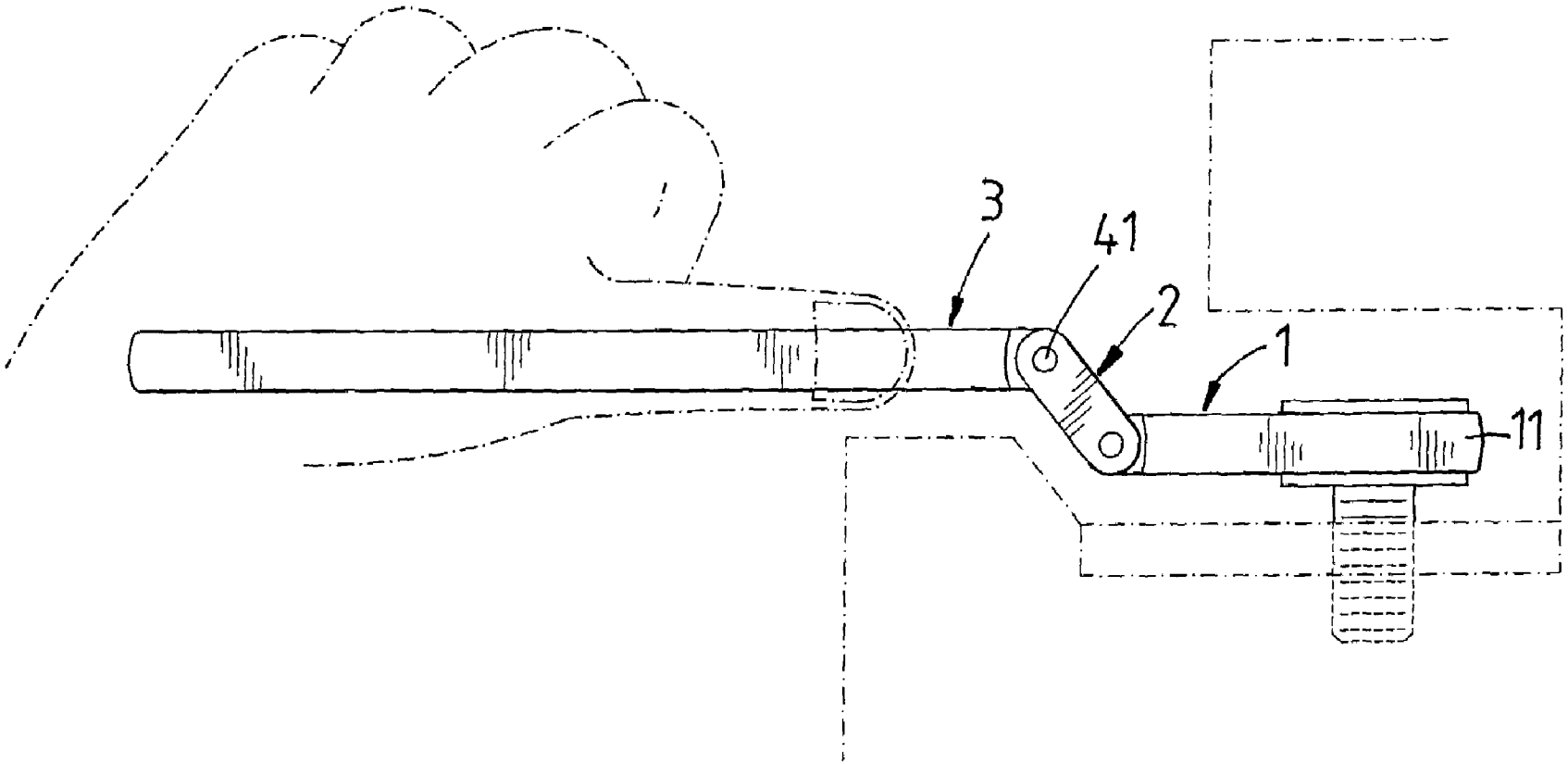
Figure 8:
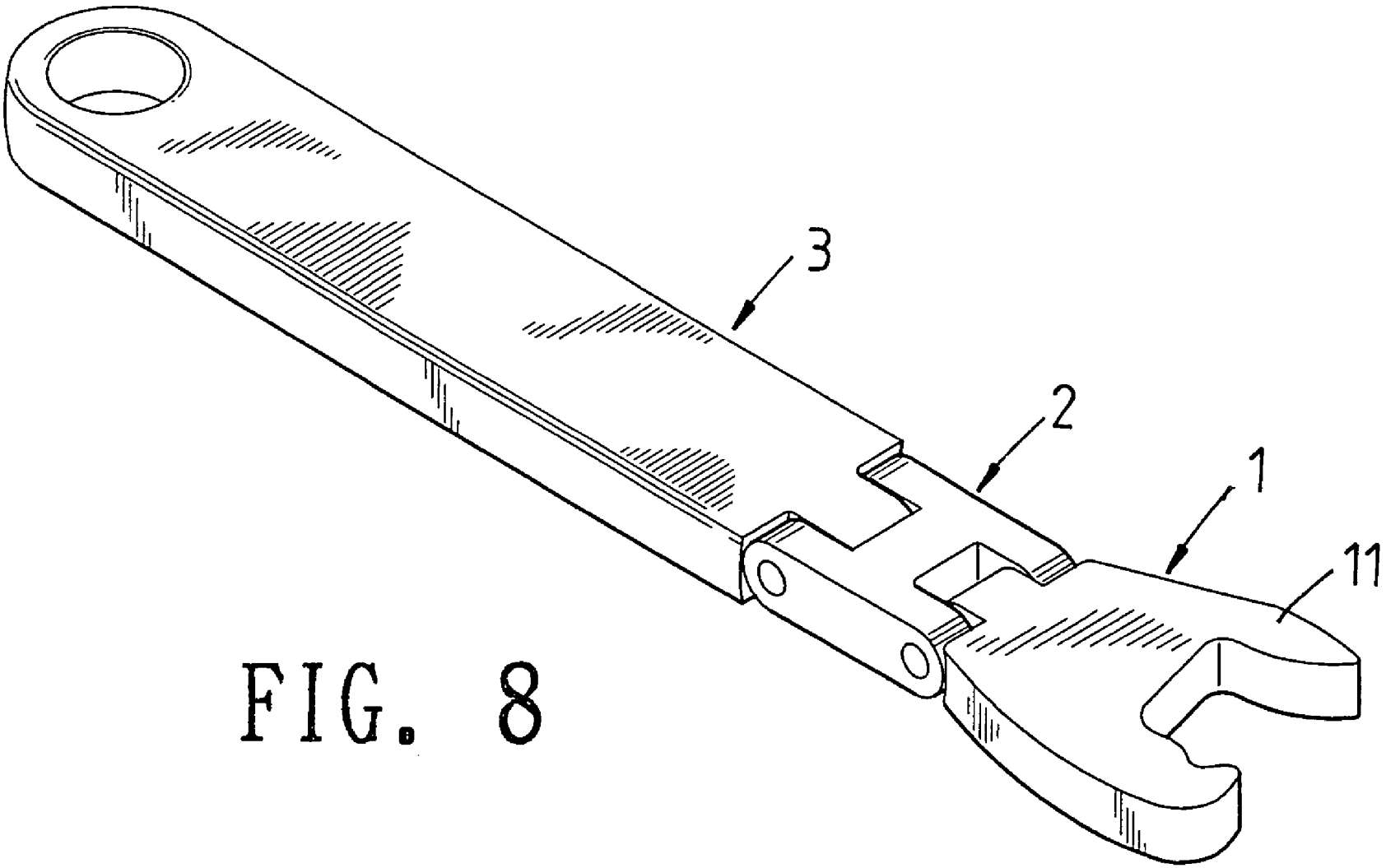
FIG. 8 is a schematic view about the bendable spanner of the present invention.

Referring to FIGS. 1, 2 and 8. The bendable spanner of the present invention is illustrated. The bendable spanner has the following elements.

A driving head 1 has a driving portion 11 at a front end thereof. The driving portion 11 serves to be engaged with a screw means so as to rotate the screw means. A first pivotal block 12 is formed at a rear end of the driving portion 11. An outer side of the first pivotal block 12 is formed with a first hole 121. The length from the front end to the rear end of the driving head 1 is L3.

A pivotal unit 2 has two recesses 21 at a front end and a rear end thereof. A first pivotal shaft 41 passes through the recess 21 at the front end of the pivotal unit 2 and the first hole 121 of the driving portion 11 so that the first pivotal block 12 is pivotally installed to the pivotal unit 2. The length from the front end to the rear end of the pivotal unit 2 is L2.

A holding portion 3 has a second pivotal block 31. The pivotal block 31 has a second hole 311. A second pivotal shaft 41 passes through the recesses 21 at a rear end of the pivotal unit 2 and the second hole of the holding portion 3 so as to pivotally install the holding portion 3 to the pivotal unit 2. A rear end of the holding portion 3 serves to be held by users for driving the screw means. The length of the holding portion 3 from the front end to the rear end thereof is L1. In the present invention, the length of L1 is greater than or equal to 1.5 times of the L2. Furthermore, the length of L1 is greater than or equal to 1.15 times of L3.

In assembly of the present invention, the first pivotal block 12 and second pivotal block 31 of the driving head 1 and the holding portion 3, respectively, are engaged into the recesses 21 of the pivotal unit 2. Then the two pivotal shafts 41 pass through the holes 211, 311 serve to fix the holding portion 3 and driving head 1 to the pivotal unit 2. An assembly view of the present invention is illustrated in FIG. 8.

Furthermore, referring to FIG. 1, a C ring may be added to the pivotal shaft 41 for fix the pivotal shaft 41.

Figure 7:
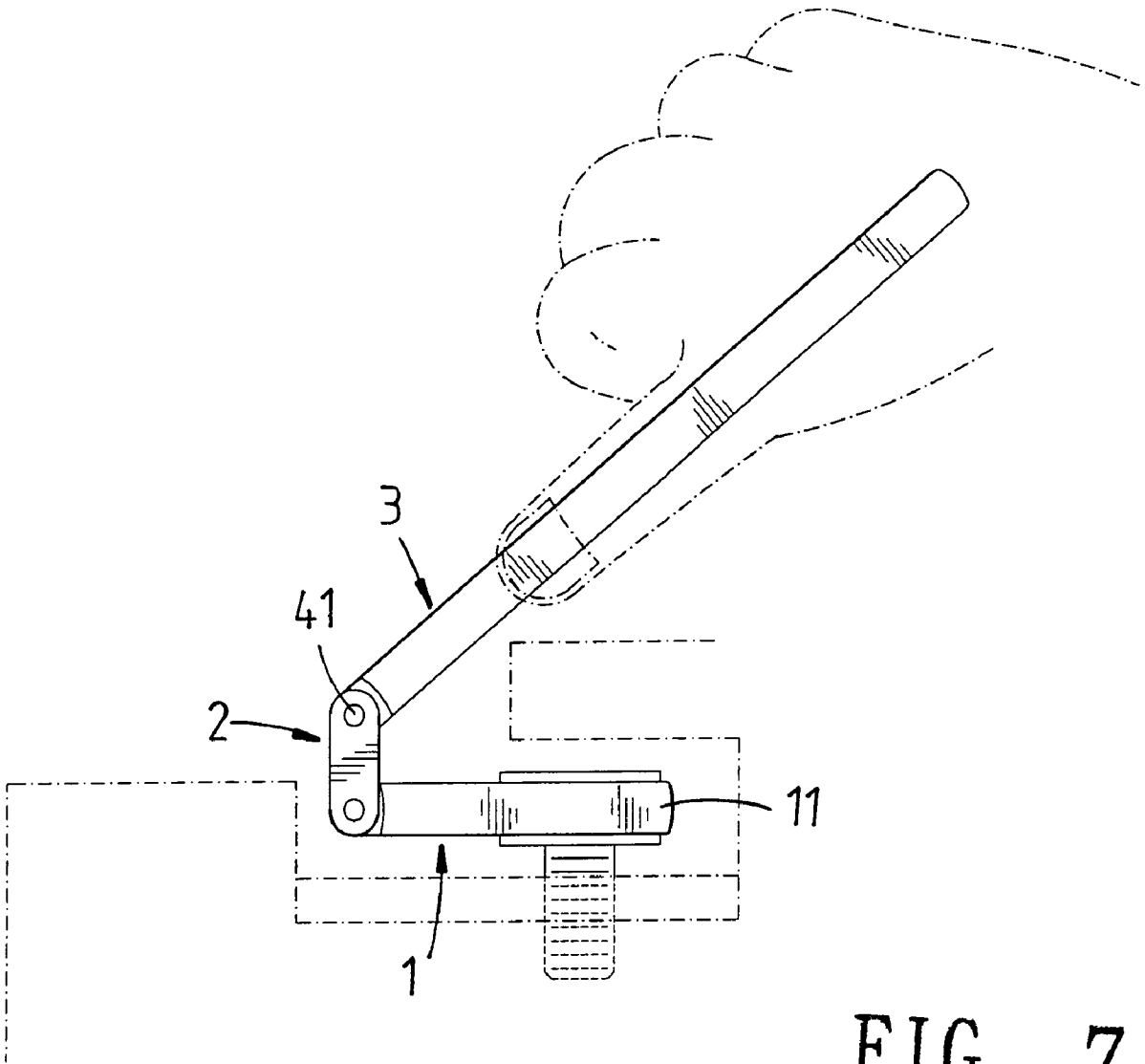

Referring to FIGS. 3 to 7, in use of the present invention, it is illustrated that the driving head 1 is engaged to a screw means. In this application, the bendable spanner is adjusted to a configuration to suit various working conditions. In FIG. 7, it is illustrated that the bendable spanner of the present invention is adjusted to a special configuration. However in the present invention, the length of L1 is greater than or equal to 1.5 times of the L2 and the length of L1 is greater than or equal to 1.15 times of L3. Thus, it has a longer holding length so that the user can work efficiently.

Figure 9:
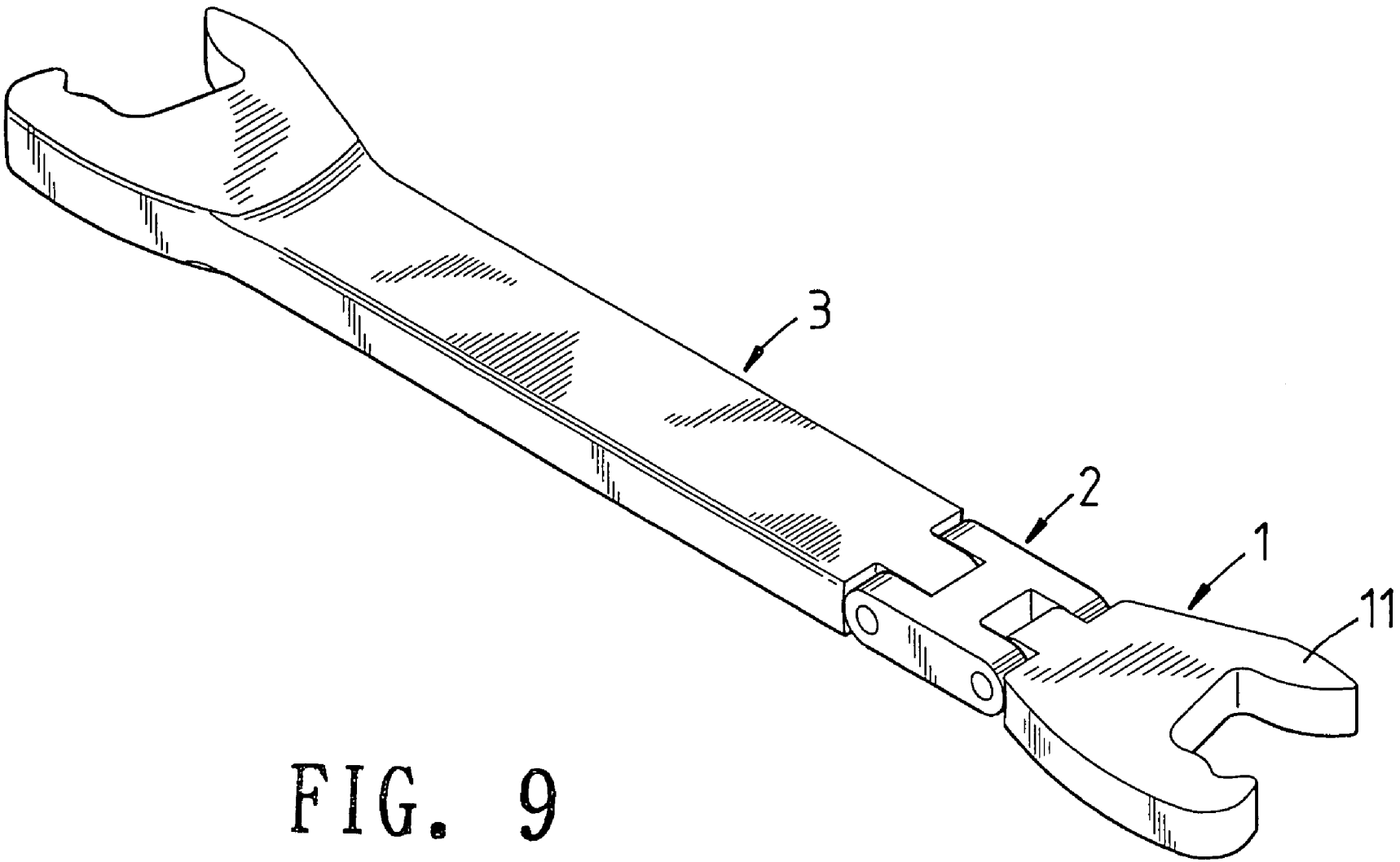
FIG. 9 shows the second embodiment of the present invention.

Referring to FIG. 9, the second embodiment of the present invention is illustrated. Those same as the first embodiment will not be further described herein. It is illustrated that the rear end of the holding portion 3 is formed as an opened end spanner.

Figure 10:
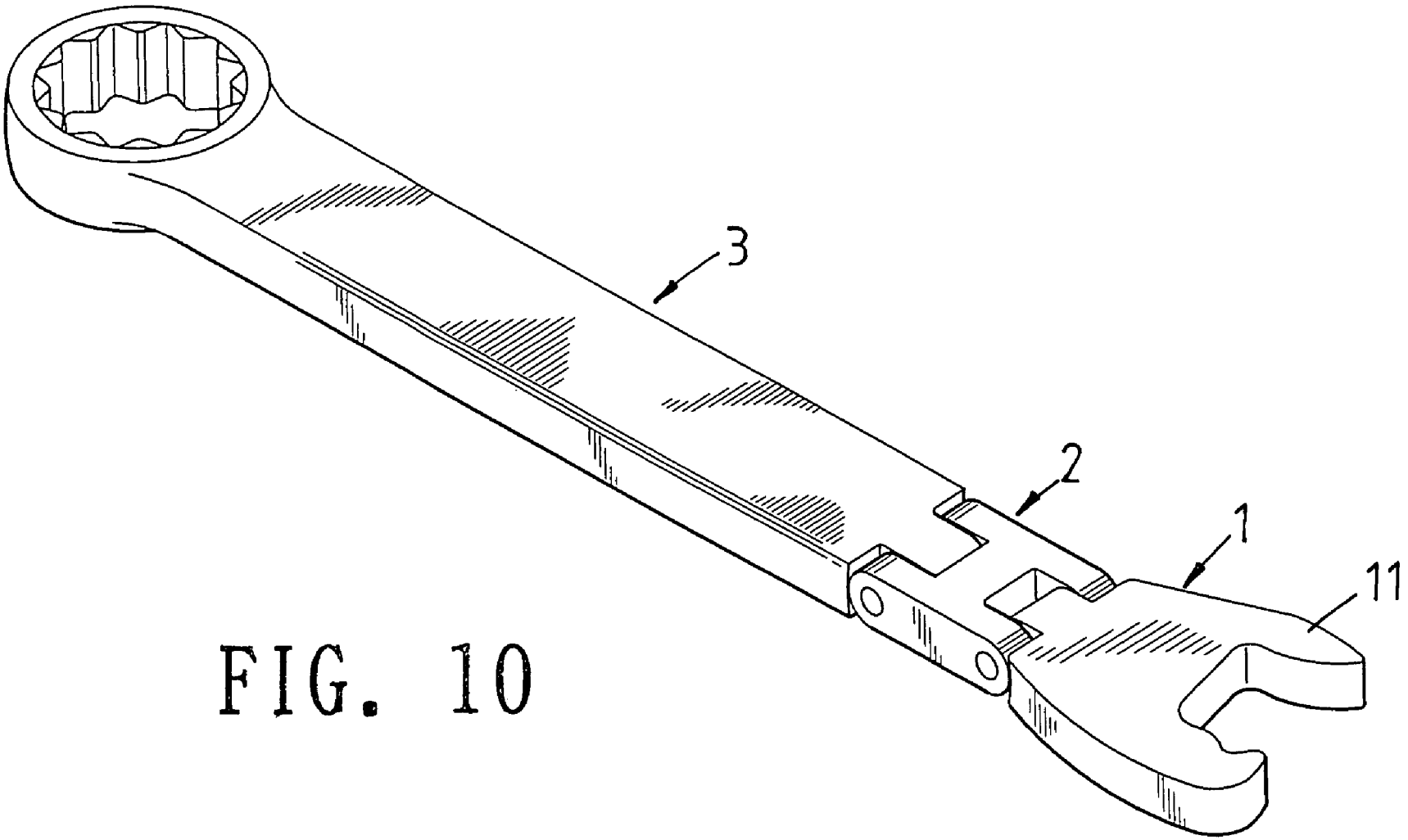
FIG. 10 shows the third embodiment of the present invention.

Referring to FIG. 10, the third embodiment of the present invention is illustrated. Those same as the first embodiment will not be further described herein. It is illustrated that the rear end of the holding portion 3 is formed as a ring spanner.

Figure 11:
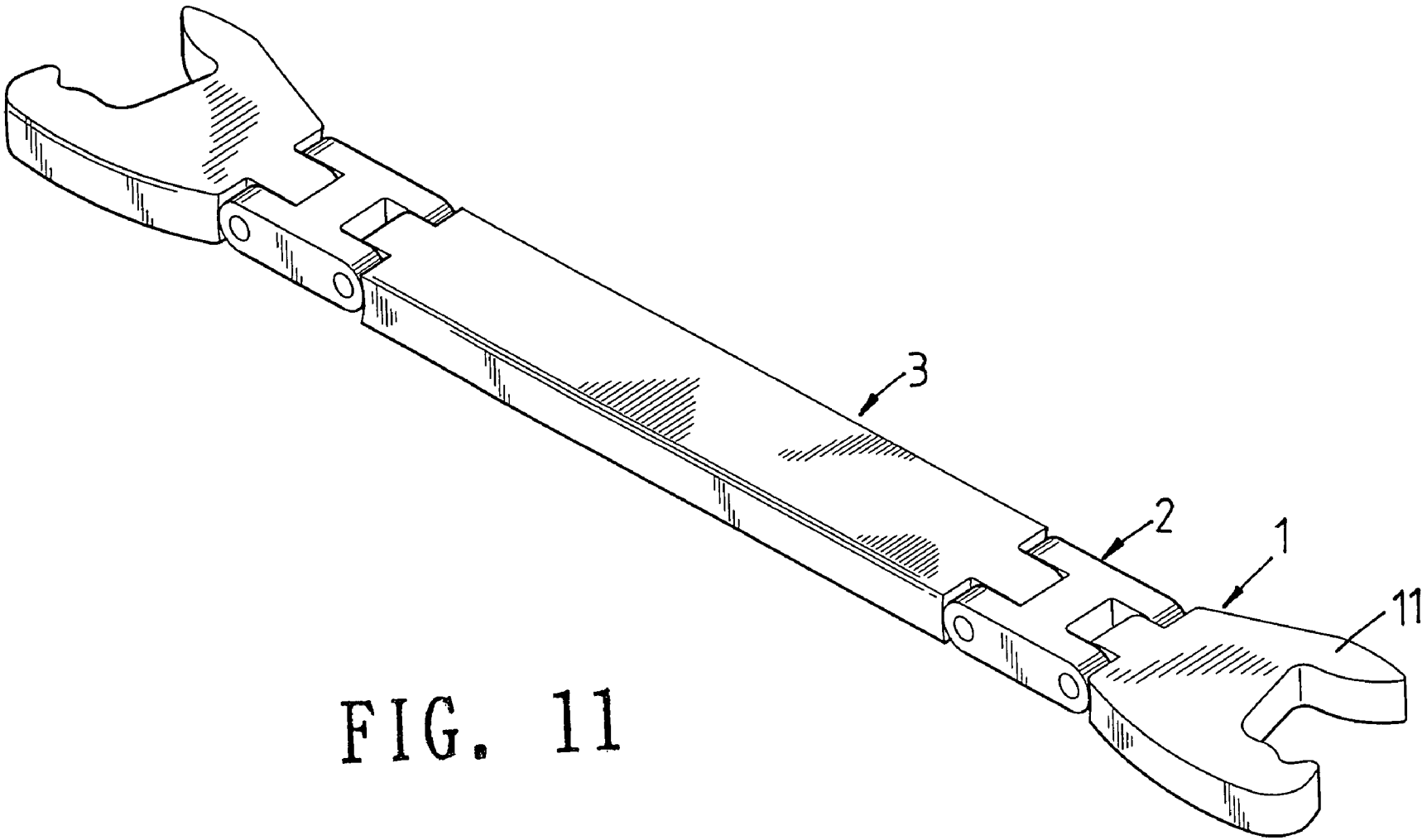
FIG. 11 shows the fourth embodiment of the present invention.

Referring to FIG. 11, the fourth embodiment of the present invention is illustrated. Those same as the first embodiment will not be further described herein. It is illustrated that that each of two ends of the holding portion 3 is pivotally installed with a pivotal unit 2 and each pivotal unit 2 is pivotally installed with a driving head 1.

Figure 12:
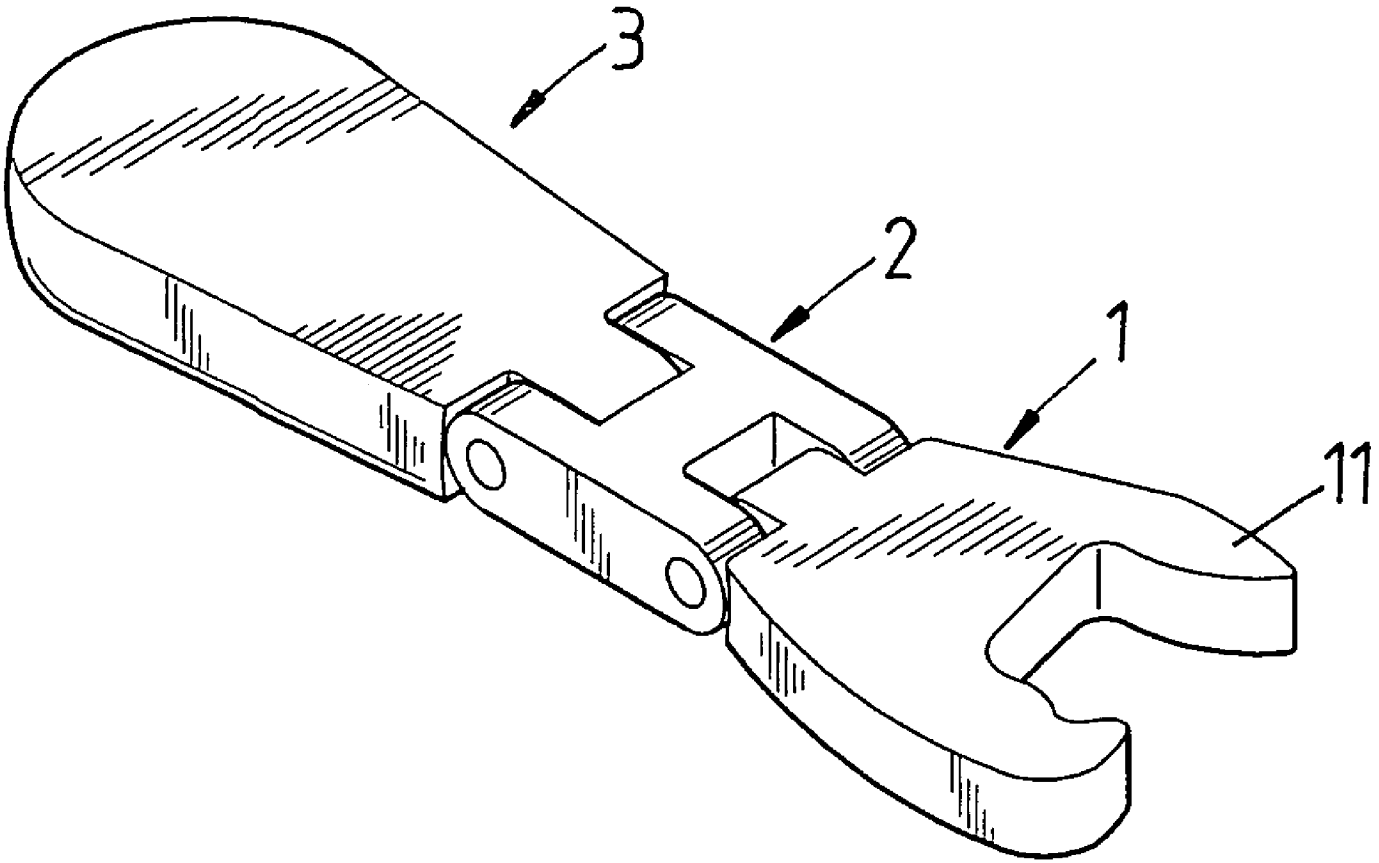
FIG. 12 shows the fifth embodiment of the present invention.

Referring to FIG. 12, the fifth embodiment of the present invention is illustrated. Those same as the first embodiment will not be further described herein. It is illustrated that it is illustrated that the holding portion 3 is shortened.

Furthermore, in the present invention, the driving portion 11 may has an open end, a ring end, or as a ratchet driver, etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bendable spanner comprising:

a driving head having a driving portion at a front end thereof for engaging with a screw means; a length of the driving head being L3;

a pivotal unit; the driving head being pivotally installed to the pivotal unit; a length of the pivotal unit being L2; and a holding portion; one end of the holding portion being pivotally installed to the pivotal unit; a length of the holding portion being L1;

wherein the length of L1 is greater than or equal to 1.5 times of the L2, and the length of L1 is greater than or equal to 1.15 times of L3;

wherein a first pivotal block is formed at a rear end of the driving portion; the pivotal unit has an integral "H" shape which has two lateral sides and only one transversal rod connecting between the two lateral sides so as to form two recesses at a front end and a rear end thereof; the first pivotal block is located in the recess at the front end of the pivotal unit; a first pivotal shaft passes through two lateral sides of the recess at the front end of the pivotal unit and the driving portion so that the first pivotal block is pivotally installed to the pivotal unit;

the holding portion has a second pivotal block; the second pivotal block is located within the recess at a rear end of the pivotal unit; a second pivotal shaft passes through two lateral sides of the recesses at a rear end of the pivotal unit and a hole of the second pivotal block of the holding portion so as to pivotally install the holding portion to the pivotal unit.

2. The bendable spanner as claimed in claim 1, further comprising:

a second driving head having a second driving portion at one end thereof for engaging with a screw means; and a second pivotal unit; another end of the second driving head being pivotally installed to one end of the second pivotal unit; another end of the second pivotal unit being pivotally installed to another end of the holding portion.

3. The bendable spanner as claimed in claim 1, wherein a C ring is added to the pivotal shaft for affixing the pivotal shaft.

4. The bendable spanner as claimed in claim 1, wherein the driving portion is one of an opened end head, a ring head, and a ratchet driver.

* * * * *